United States Patent [19]

Renault

[11] Patent Number: 4,886,244

[45] Date of Patent: Dec. 12, 1989

[54] HYDRAULIC LIFT PERFECTED FOR THE LIFTING AND THE HANDLING OF HEAVY LOADS OF SEVERAL TONS

[76] Inventor: Jacques Renault, 16 Rue Lamothe, Lyon 7 e'me Rhône, France

[21] Appl. No.: 209,304

[22] Filed: Jun. 21, 1988

[30] Foreign Application Priority Data

Jun. 22, 1987 [FR] France ..... 87 09101

[51] Int. Cl.[4] ..... B66F 3/24

[52] U.S. Cl. ..... 254/932 P

[58] Field of Search ..... 254/93 R, 93 H, 133 R, 254/DIG. 4; 72/705; 29/239

[56] References Cited

U.S. PATENT DOCUMENTS

| | | | |
|---|---|---|---|
| 87,453 | 3/1869 | Ryan | 254/93 H |
| 2,412,414 | 12/1946 | Mueller | 254/93 H |
| 2,654,568 | 10/1953 | Pine | 254/93 H |
| 3,081,066 | 3/1963 | Murawski | 254/93 R |
| 3,370,421 | 2/1968 | Piper | 254/93 R |
| 4,021,018 | 5/1977 | Dasan | 254/93 H |
| 4,174,095 | 11/1979 | Chipman | 254/93 H |
| 4,270,733 | 6/1981 | DePue | 254/93 R |
| 4,783,053 | 11/1988 | Yimiyahu et al. | 254/93 R |

*Primary Examiner*—Robert C. Watson

*Attorney, Agent, or Firm*—Arnold S. Weintraub

[57] ABSTRACT

This jack comprises a body of a jack mounted to allow the jack to slide and sealed on a guiding column associated at a supporting plate at ground level. It comprises two lifting zones: on the one hand by its upper part, and on the other hand, by its lower ledge, guided on this column and associated at the body of the jack. This jack body is arranged in its back part with a housing forming a reservoir and protecting the pumping means of functioning. The pump body receives a pump piston joined at the operating lever. The body of the pump receives an intake valve emerging in the reservoir. The intake valve [25] is set out angularly oriented in a perpendicular plane at the median longitudinal plane of the jack and guided toward the bottom, being also emerged when the jack is utilized in horizontal position. One method of lining up the intake valve's position is set out laterally on the side of the housing opposite this valve.

10 Claims, 2 Drawing Sheets

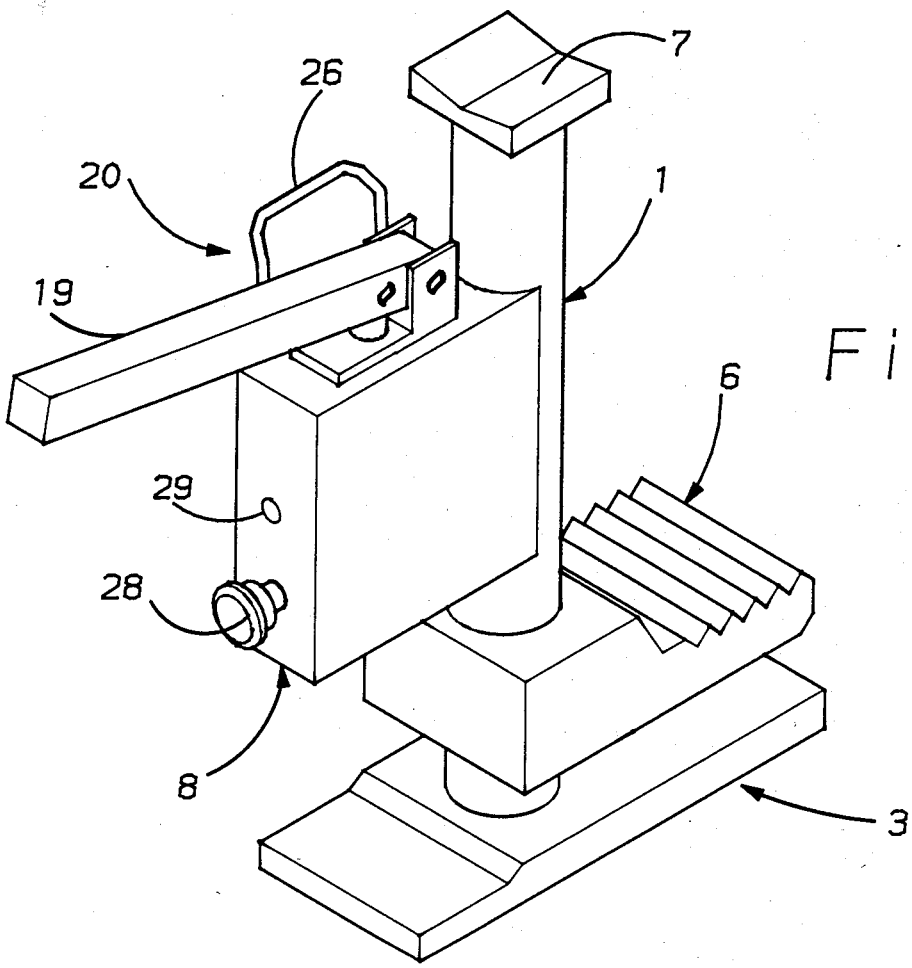
Fig-1
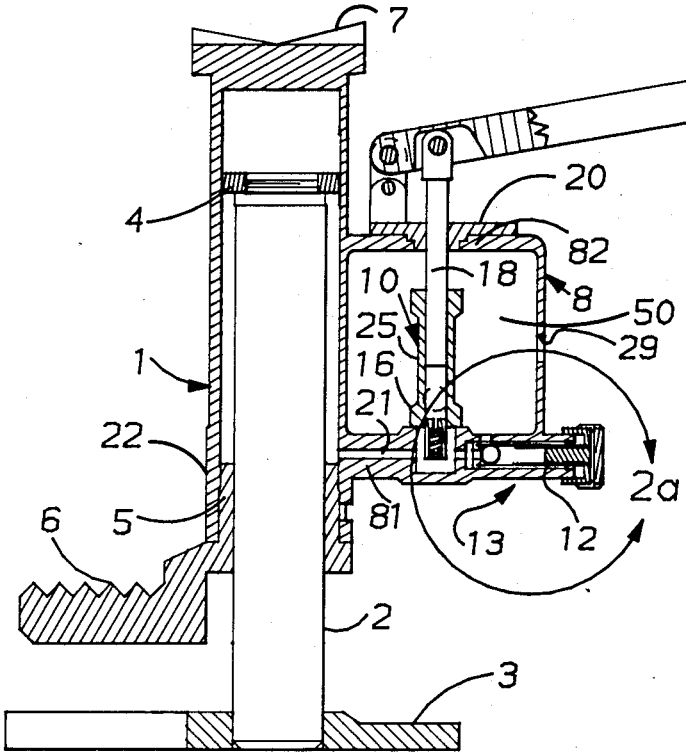
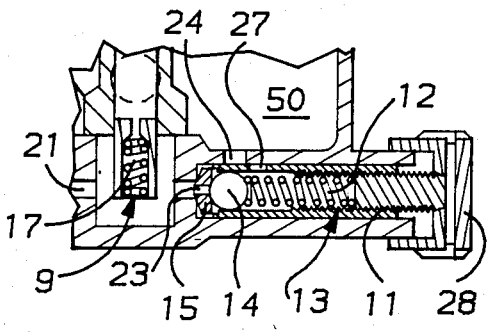
Fig-2a
Fig-2

HYDRAULIC LIFT PERFECTED FOR THE LIFTING AND THE HANDLING OF HEAVY LOADS OF SEVERAL TONS

SUMMARY OF THE INVENTION

The present invention has for its object a hydraulic jack perfected and adapted for the lifting and the handling of heavy loads of several tons.

One knows of hydraulic jacks of this genre capable, from ground level, of lifting loads on the order of five, ten, twenty tons and more. These jacks are arranged to assure the engagement of the load at two possible levels either by a fastening set out at the lower part of the jack or by the head set out in the upper part associated at the jack. A gripping handle is shaped like a U section from which the arms are each fixed laterally on the housing and permits the transportation of the jack.

Just as it is realized to date, a similar hydraulic jack normally works independently only if it used in the vertical position. Previous jack designs are not however adapted to be utilized in a horizontal position.

The sought after goal according to the invention is to remedy this inconvenience.

According to a first characteristic, the jack is remarkable in that it comprises an intake valve set out angularly orientated in a perpendicular plane at the horizontal median plane of the jack and guided toward the bottom, being immersed in fluid when the jack is utilized in the horizontal position wherein a manner of identifying the position of the intake valve is laterally placed on the side of the housing opposite the valve.

In order to render the object of the invention more concrete, one now describes it in a nonrestrictive manner illustrated at the figures of the drawings:

BRIEF DESCRIPTION OF THE DRAWINGS

FIG. 1 is a view in perspective illustrating the perfected jack taken in its entirety.

FIG. 2 is a view in transverse section of the jack according to FIG. 1 in the vertical functioning position.

FIG. 2*a* is a detailed view of the output/safety valve.

DESCRIPTION OF THE PREFERRED EMBODIMENT

Figure 3:
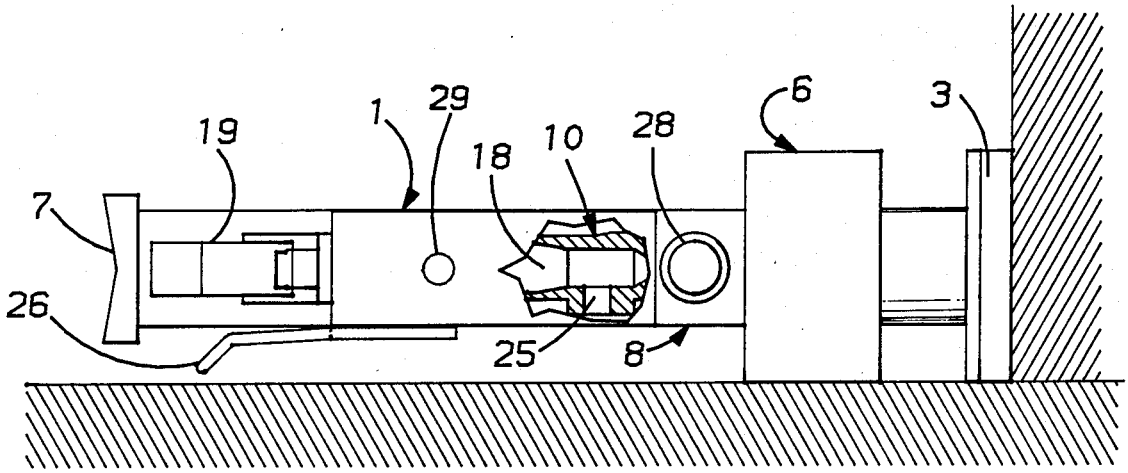
FIG. 3 is a view of the side of the jack in the horizontal functioning position.
Figure 4:
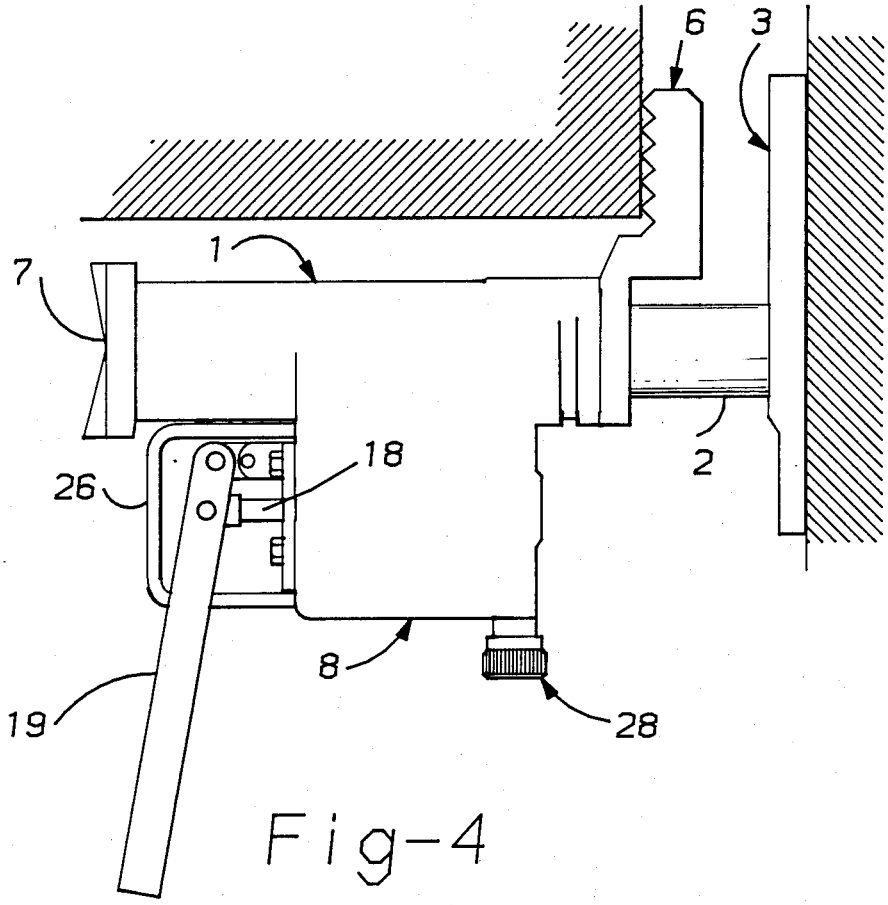
FIG. 4 is a plane view according to FIG. 3.

In order to render the object of the invention more concrete, one now describes it in a nonrestrictive manner.

The hydraulic jack to be used in a horizontal or vertical position comprising a body of a jack (1), having a hollow interior diameter wherein the body is mounted and sealed on a guiding column (2) to allow the jack to slide on the column. The column comprises an upper section and a lower base section and a front section and a back section. A support bed plate (3) is located at the lower base section of the guiding column and is amply dimensioned for the stability of the entirety. The body of the jack is guided on this column in its upper part by a guiding screw (4) and in this lower part by a sheath (5) introduced for sealing and forming in its lower part an extension constituting a first lifting surface (6) for lifting the loads. This lifting surface is firmly associated at the body of the jack with the capability to rotate. The upper part of the body of the jack constitutes a second lifting surface (7) capable of supporting a load.

Connected to the body of the jack on the back section of the guiding column is a protective pump housing (8) capable of receiving the complementary means of operating the hydraulic jack. A detailed cutaway drawing appears in FIG. 2 of the drawings and, without entering into the detail of the realization, shows that this housing is arranged to form a reservoir (50) and hydraulic fluid interior chamber (22). The part of this housing at the bottom (8-1) is arranged with openings and ducts permitting the sealed positioning of the body of a pump (10), and of an output valve (9) associated at the pump body, of an entire discharge screw (11) and of spring components (12), a stop valve (13), a ball (14), and a conical shaped nozzle (15). The discharge screw is interlocked at a driving wheel and is manipulated by a button (28) located at the exterior of the pump housing. This assembly constituting the pressure limiter. Thie pressure limiter also comprises a fluid reception chamber. The output valve comprises a ball (16), and spring (17). The output valve comprises reception chamber for the receipt of fluid. The body of the pump, arranged in the same plane as the body of the jack, permits the sealed sliding of the piston of the pump (18) where the upper extremity is interlocked by a fulcrum a driving and operating lever (19) for the level jack. The reservoir comprises an opening (8-2) for the passage of the piston and the positioning of a piston cover (20) for protection and guiding of the piston.

As shown in the drawings, the bottom (8-1) of the pump housing comprises a first duct (21) permitting the communication and the passage of fluid out of the output valve. An interior chamber (22) is formed between the guiding column and the interior diameter of the body of the jack, and receives fluid from the output valve.

In order to permit the return of the fluid, three openings are provided, (23) (24) and (27).

The opening (23) is set out between the reception chamber of the output valve (9) and the reception chamber of the pressure limiter. The conical shaped nozzle (15) closes this opening (23) by the manual action of turning the maneuvering button (28) and the discharge screw (11) in against this nozzle (15).

The opening (24) permits the pressurized fluid to return to the reservoir.

The output valve serves two functions:

(1) Voluntary return to lower the load previously lifted: By operating the button (28) to screw out the discharge screw (11), the conical shaped nozzle no longer plugs/closes the orifice (23) and there is a return of the fluid by the orifice (24).

(2) Safety relief in cases of overloading: The overpressure pushes the spring loaded ball (14) off its seat against the nozzle (15), permitting the fluid to pour out in the reservoir by the intermediary orifice (27) employed in the discharge screw and evacuating next by the orifice (24).

According to the invention, the hydraulic jack of the aforementioned type works equally well whether in the horizontal or vertical position. As shown in FIG. 3, the intake valve (25) is set out on the body of the pump (10) above the output valve and emerges in the fluid reservoir. The intake valve is oriented in such a way that however extreme the orientation of the hydraulic jack during use, i.e. whether positioned vertically or horizontally, the valve (25) is immersed in the fluid, thus avoiding contact with air in the reservoir. The intake valve, is of a ball type, and is set out angularly orientated in a plane perpendicular to the median longitudinal plane of the jack. Thus, once the jack is in the horizontal position such as is illustrated in FIG. 3, this intake valve finds itself with the head orientated toward the bottom being totally or sufficiently immersed in order to not be in contact with the air.

The jack further comprises a method of lining up the jack that permits precise identification of the lateral side where the intake valve is positioned. A gripping handle (26) is fixed by welding or otherwise at the housing of the jack.

The handle is reinforced to constitute a support base to level the apparatus when it is utilized in the horizontal position. The correct position of the jack is indicated by the position of the handle.

The method of correctly positioning the jack is comprises placement of the handle so that the jack is stabilized at the horizontal.

The position indicating means means can also be a visual reference, band type or inscription of information, glass window located at the side of the intake valve or other similar means to allow a user to see when the intake valve is immersed in hydraulic fluid.

A means contributing to the horizontal stability of the jack, in addition to the handle may comprise an extension forming a support member at the place of the handle in the preceding embodiment.

The advantages stand out well in the description. One emphasizes the improvements and the complimentary, advantageous embodiment of the hydraulic jack.

I claim:

1. A hydraulic jack to be used in a horizontal or vertical position comprising: a guiding column having an upper section and a lower base section, and a front section and a back section;

a first lifting surface and a second lifting surface wherein the first lifting surface is located at the upper section of the guiding column and the second lifting surface is located at the lower base section of the column;

a support bed plate located at the lower base section of the guiding column and tightly fitted to the guiding column;

a jack body located on the guiding column;

a guiding screw located at the upper section of the guiding column for directing the body of the jack on the guiding column;

a hydraulic system for raising and lowering the lifting surface comprising: an intake valve which is immersed in hydraulic fluid when the jack is positioned vertically or horizontally; a fluid reservoir operably connected to the input valve for holding fluid under pressure; and a dual output/pressure relief valve to release fluid from the reservoir, and to release fluid in the event of a weight overload.

2. The hydraulic jack of claim 1 wherein:

the hydraulic system further comprises: a pump housing having an interior and an exterior;

an interior fluid chamber which receives fluid from the fluid reservoir wherein fluid is pressurized;

a piston disposed within the housing which moves hydraulic fluid into and out of the fluid reservoir;

a piston cover for guiding and protecting the piston;

an operating lever operably connected to the pump piston for pumping hydraulic fluid through the pumping means;

an intake valve set out on the exterior of the pump housing and connected to the fluid reservoir for directing fluid flow into the reservoir;

a series of channels for directing fluid through the pumping means; and wherein the dual output/pressure relief valve allows fluid flow out of the fluid reservoir and provides a gradual release of pressurized fluid into the fluid reservoir in the case of weight overload.

3. The hydraulic jack of claim 2, wherein the output valve of the pumping means is located in the fluid reservoir and comprises a stop valve having a ball and spring closure; a discharge screw which turns inward or outward to close or open the stop valve, and a conical nozzle which is controlled by the stop valve and provides a channel fluid flow between the fluid reservoir and the interior fluid chamber.

4. The hydraulic jack of claim 2, wherein fluid pressure is created within the interior chamber, by the pressure of the pump piston on the hydraulic fluid, within the interior chamber.

5. The hydraulic jack of claim 2, further comprising:

a gripping handle connected to the exterior of the pump housing;

6. The hydraulic jack of claim 5 wherein the gripping handle comprises a support base for the jack in the horizontal position.

7. The hydraulic jack of claim 2 wherein the intake valve is immersed in fluid when the jack is utilized in the horizontal position.

8. The hydraulic jack of claim 2 further comprising:

means for indicating correct positioning of the jack, the means comprising a visual reference located on the exterior of the pump housing which indicates the position of the intake valve.

9. The hydraulic jack of claim 8 wherein the means for indicating correct positioning of the jack comprises a closed glass window positioned laterally on the exterior of the pump housing adjacent to the intake valve to allow viewing of the intake valve.

10. The jack of claim 2, further comprising:

a complimentary means for forming an additional support member laterally set out on the housing exterior of the pump near the jack handle.

* * * * *